US008205595B2

(12) United States Patent
Mizuno

(10) Patent No.: US 8,205,595 B2
(45) Date of Patent: Jun. 26, 2012

(54) CONTROL DEVICE FOR INTERNAL COMBUSTION ENGINE

(75) Inventor: Hiroshi Mizuno, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 747 days.

(21) Appl. No.: 12/445,186

(22) PCT Filed: Oct. 10, 2007

(86) PCT No.: PCT/JP2007/070217

§ 371 (c)(1),
(2), (4) Date: Apr. 10, 2009

(87) PCT Pub. No.: WO2008/047816

PCT Pub. Date: Apr. 24, 2008

(65) Prior Publication Data

US 2010/0006064 A1 Jan. 14, 2010

(30) Foreign Application Priority Data

Oct. 10, 2006 (JP) ..... P2006-276662

(51) Int. Cl.
*F02D 29/02* (2006.01)
*F02D 41/00* (2006.01)

(52) U.S. Cl. ..... 123/350

(58) Field of Classification Search ..... 123/350, 123/339.1, 339.16, 339.18
See application file for complete search history.

(56) References Cited

U.S. PATENT DOCUMENTS 4,582,032 A * 4/1986 Hara et al. ..... 123/339.11
6,397,814 B1 * 6/2002 Nagaishi et al. ..... 123/348
7,070,537 B2 * 7/2006 Polom et al. ..... 477/3
2005/0164828 A1 7/2005 Polom et al.

FOREIGN PATENT DOCUMENTS

| | | | |
|---|---|---|---|
| DE | 198 47 457 | A1 | 4/2000 |
| JP | 60-065241 | | 4/1985 |
| JP | 2-252931 | A | 10/1990 |
| JP | 5-340282 | A | 12/1993 |
| JP | 11-005461 | A | 1/1999 |
| JP | 11-257121 | A | 9/1999 |
| JP | 2002-021599 | A | 1/2002 |
| JP | 2002-303177 | A | 10/2002 |
| JP | 2003-314326 | A | 11/2003 |
| JP | 2003-320871 | A | 11/2003 |
| JP | 2007-009885 | A | 1/2007 |

* cited by examiner

*Primary Examiner* — Hieu T Vo
(74) *Attorney, Agent, or Firm* — Kenyon & Kenyon LLP

(57) ABSTRACT

The object of the present invention is to provide an internal combustion engine control apparatus which can control an internal combustion engine output with a high accuracy even when an internal combustion engine output lower than an unloaded idling equivalent output is demanded. The internal combustion engine of the present invention has an accessory such as a generator driven through an output axis of the engine, an ECU for totally controlling the engine and accessory, and an accessory driving control section for controlling the driving of the accessory. The ECU calculates a target engine output according to a demand from a driver or the like and, when the target engine output is lower than the unloaded idling equivalent output, sends a control signal to the accessory driving control section 16 so as to increase the load of the accessory and further make the idle-up amount zero. When the target engine output is not lower than the unloaded idling equivalent output, an idle-up amount corresponding to the load of the accessory is determined. Then, the idle-up amount of output is added to the target engine output, and the engine device is controlled according to thus calculated value.

5 Claims, 4 Drawing Sheets

CONTROL DEVICE FOR INTERNAL COMBUSTION ENGINE

This is a 371 national phase application of PCT/JP2007/070217 filed 10 Oct. 2007, claiming priority to Japanese Patent Application No. JP 2006-276662 filed 10 Oct. 2006, the contents of which are incorporated herein by reference.

TECHNICAL FIELD

The present invention relates to an internal combustion engine control apparatus for controlling an internal combustion engine mounted to an automobile or the like.

BACKGROUND ART

Known as an example of apparatus for controlling an internal combustion engine (engine) mounted to an automobile or the like is a so-called torque demand control which computes a target engine output (torque) according to an opening degree of an accelerator operated by a driver or the like and controls the throttle opening degree in response to the target torque as described in Japanese Patent Application Laid-Open No. 2002-303177.

DISCLOSURE OF INVENTION

However, the above-mentioned prior art does not consider any control in the case where a target engine output lower than an output at the time of unloaded idling (unloaded idling equivalent output) is calculated.

It is an object of the present invention to provide an internal combustion engine control apparatus which can control the internal combustion engine output with a high accuracy even when an internal combustion engine output lower than the unloaded idling equivalent output is demanded.

The present invention is an internal combustion engine control apparatus for controlling an internal combustion engine mounted to a vehicle, the apparatus comprising an accessory driven through an output axis of the internal combustion engine, accessory control means for controlling a load of the accessory, output target setting means for setting an output target value of the internal combustion engine, and output control means for controlling an output of the internal combustion engine by using the output target value set by the output target setting means; wherein the accessory control means controls the load of the accessory such that the load increases when the output target value is lower than an output during unloaded idling.

When decelerating in an expressway or running a downhill, for example, the internal combustion engine may be driven such as to yield an output lower than an output during unloaded idling (unloaded idling equivalent output). For attaining such an internal combustion engine output lower than the unloaded idling equivalent output, it is necessary to use controls such as cutting the fuel, stopping the cylinder, and retarding the ignition in addition, which allows only ON/OFF or stepwise controls, thereby making it difficult to finely control the internal combustion engine output. Meanwhile, accessories such as a generator and an air compressor are connected to and driven through the output axis of the internal combustion engine. The present invention efficiently utilizes the load of such an accessory and effectively controls the output of the internal combustion engine.

That is, an output target value of the internal combustion engine is set by the output target setting means, and whether the output target value is lower than the unloaded idling equivalent output or not is determined. When the output target value is lower than the unloaded idling equivalent output, the accessory control means controls the load of the accessory so as to make it greater. This makes the output of the internal combustion engine lower as the load of the accessory is greater, whereby an internal combustion engine output lower than the unloaded idling equivalent output can be obtained. Thus actively utilizing the control of the accessory load as a control of the internal combustion engine makes it unnecessary to perform controls such as cutting the fuel and stopping the cylinder, thereby allowing an internal combustion engine output lower than the unloaded idling equivalent output to be controlled with a high accuracy.

Preferably, the accessory control means controls the load of the accessory such that the load increases by a difference between the output target value and the output during unloaded idling when the output target value is lower than the output during unloaded idling.

This optimizes the amount of increase of accessory load with respect to the output target value of the internal combustion engine, whereby any internal combustion engine output lower than the unloaded idling equivalent output can be obtained reliably.

Preferably, the apparatus further comprises idle-up adjusting means for setting an idle-up amount in the internal combustion engine and correction means for correcting the output target value by adding an output corresponding to the idle-up amount to the output target value set by the output target setting means, the output control means controls the output of the internal combustion engine according to the output target value corrected by the correction means, and the idle-up adjusting means usually determines the idle-up amount corresponding to the load of the accessory and sets the idle-up amount smaller than usual when the output target value set by the output target setting means is lower than the output during unloaded idling.

Usually, i.e., when the output target value of the internal combustion engine is greater than the unloaded idling equivalent output, an idle-up amount corresponding to the load of the accessory is determined, the output target value is corrected by using this idle-up amount, and the output of the internal combustion engine is controlled according to thus corrected output target value, whereby a stable idling state can be realized even when the load of the accessory changes. When the output target value of the internal combustion engine is lower than the unloaded idling equivalent output, on the other hand, the idle-up amount is set smaller than usual, so that the energy generation necessary for the idle-up control is suppressed, whereby the fuel consumption can be cut down.

DESCRIPTION OF EMBODIMENTS

In the following, a preferred embodiment of the internal combustion engine control apparatus in accordance with the present invention will be explained in detail with reference to the drawings.

Figure 1:
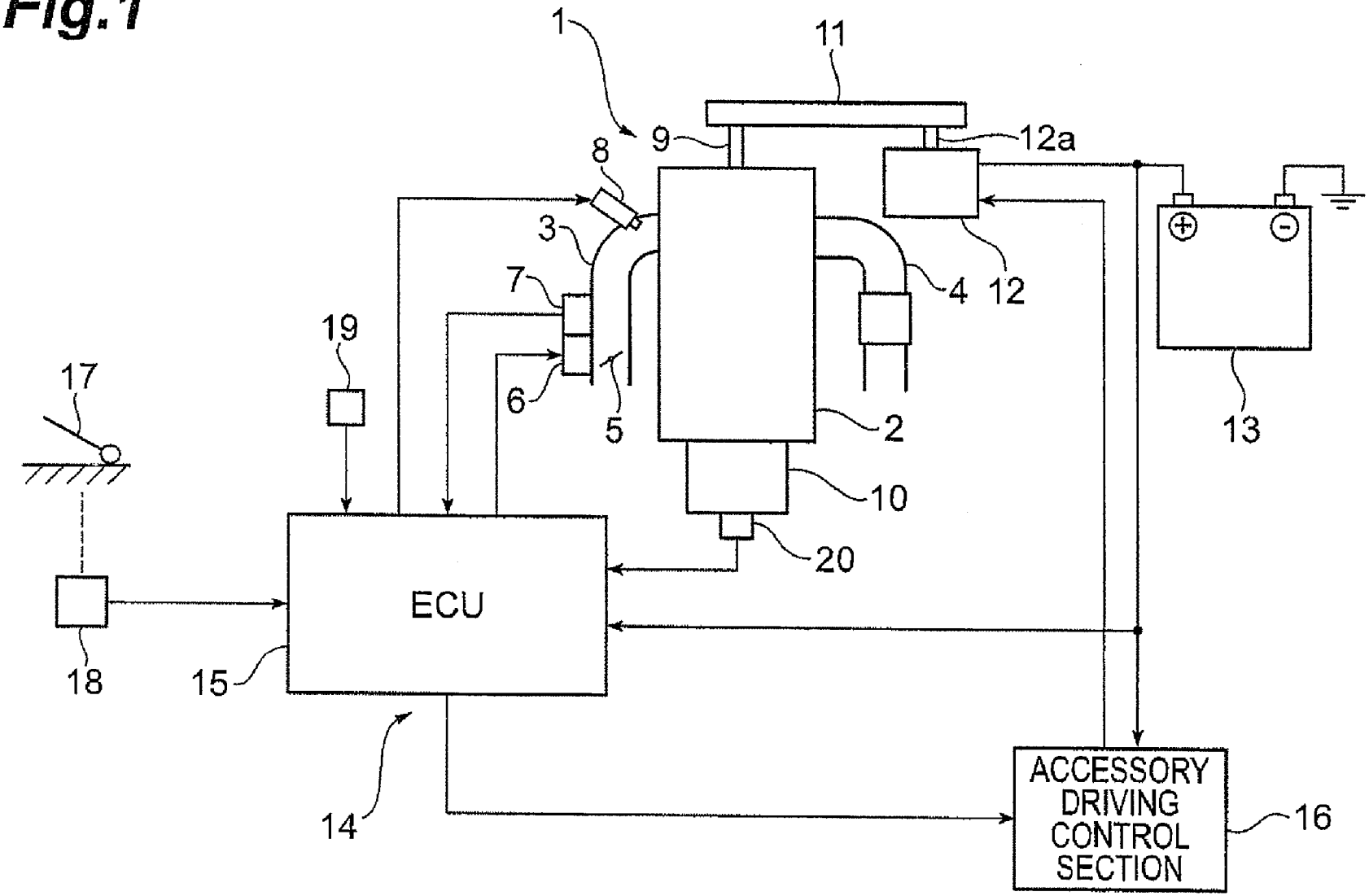
FIG. 1 is a schematic configuration diagram illustrating an embodiment of the internal combustion engine control apparatus in accordance with the present invention together with an internal combustion engine.

FIG. 1 is a schematic configuration diagram illustrating an embodiment of the internal combustion engine control apparatus in accordance with the present invention together with an internal combustion engine. In this drawing, an engine 1, which is an internal combustion engine mounted to a vehicle such as an automobile, is equipped with an engine body 2 for burning a fuel, so as to take out power.

Connected to the engine body 2 are an intake pipe 3 for aspirating air and an exhaust pipe 4 for letting out an exhaust gas after the burning. Arranged within the intake pipe 3 is a throttle valve 5 for adjusting the amount of air aspirated into the engine body 2. The throttle valve 5 is controlled by a throttle driving motor 6. The intake pipe 3 is provided with a throttle position sensor 7 for detecting the opening degree of the throttle valve 5 (throttle opening degree). An injector 8 for supplying the fuel into the engine body 2 is attached to the intake pipe 3 in the vicinity of the engine body 2. The injector 8 may be attached to the engine body 2 as well.

A flywheel 10 is attached to one end of a crankshaft 9 built in the engine body 2. A driving part (not depicted) is joined to the flywheel 10, so that an engine output is transmitted to wheels through the driving part.

Linked to the other end of the crankshaft 9 through a drive belt 11 is a shaft 12*a* of a generator 12. Consequently, the power generated in the engine body 2 is transmitted to the power 12 through the drive belt 11, so as to drive the generator 12. A battery 13 is connected to the generator 12. The generator 12 is one of accessories driven through the output axis (crankshaft 9) of the engine 1. Other examples of the accessories include an air compressor and a hydraulic pump which are not depicted in particular. These accessories construct a part of an internal combustion engine control apparatus 14.

The internal combustion engine control apparatus 14 also has an electronic control unit (ECU) 15 for totally controlling the engine 1 and the accessories such as the generator 12, and an accessory driving control section 16 for controlling the driving of the accessories.

Connected to the ECU 15 are an accelerator position sensor 18 for detecting the amount of operation of an accelerator pedal 17, a vehicle speed sensor 19 for detecting the speed of the vehicle, and a revolution sensor 20 for detecting the number of revolutions of the engine 1. Though not depicted in particular, other sensors such as a sensor for detecting the gear lever position, for example, are also connected to the ECU 15.

The ECU 15 inputs detection signals of various sensors and output values of accessories such as the generator 12, performs predetermined arithmetic operations and the like, controls engine devices such as the throttle driving motor 6 and injector 8, and sends control signals for controlling driving loads of the accessories to the accessory driving control section 16.

The accessory driving control section 16 calculates a required electric power generation amount from the voltage of the battery 13, controls the output (electric power generation amount) of the generator 12 so as to attain the required electric power generation amount and controls outputs of the accessories including the generator 12 in response to control signals from the ECU 15.

Figure 2:
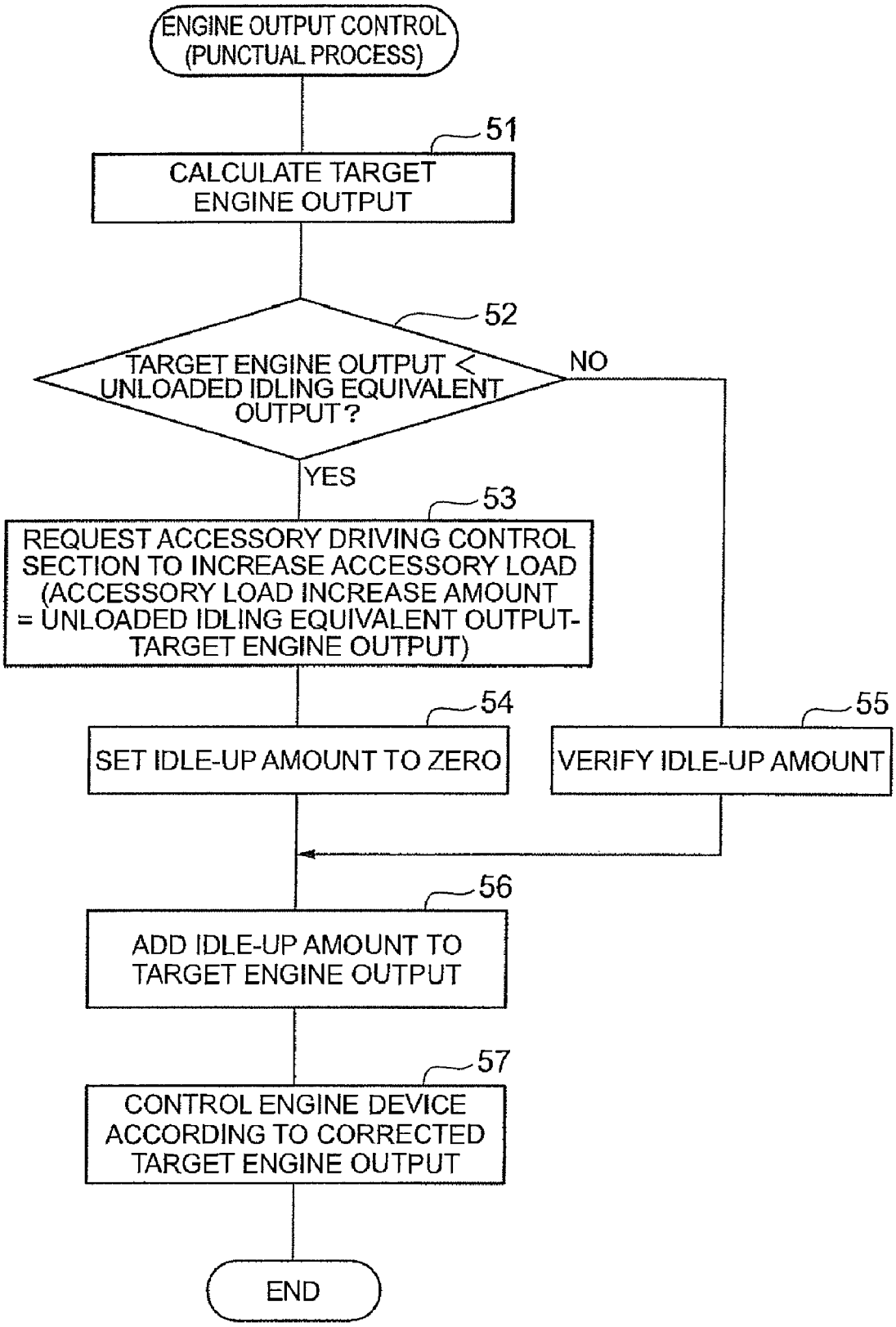
FIG. 2 is a flowchart illustrating a procedure of an engine output control process carried out by an electronic control unit (ECU) represented in FIG. 1.

FIG. 2 is a flowchart illustrating a procedure of an engine output control process carried out by the ECU 15. The process illustrated in FIG. 2, which is a part of an engine process control process executed by a program stored beforehand, is performed as a punctual process (e.g., at intervals of 4 ms).

First, in this chart, an output target value (target engine output) to be generated by the engine 1 is calculated (step 51) according to a demand from the driver. As the demand from the driver, the amount of depression of the accelerator pedal 17, the vehicle speed, the number of revolutions of the engine 1, and the like are totally taken into consideration here, whereby the arithmetic operation in this step is performed by using detection signals of the above-mentioned accelerator position sensor 18, vehicle speed sensor 19, revolution sensor 20, and the like.

The target engine output may be calculated as a direct engine output or torque unit or a control amount, such as throttle opening degree or engine load, which indirectly defines the engine output. When calculated as a direct unit, however, the target engine output is a target value of a net output (axial output or axial torque) taken out of the crankshaft 9.

Subsequently, it is determined whether the target engine output determined at step 51 is lower than the output during unloaded idling (hereinafter referred as unloaded idling equivalent output) or not (step 52). Here, the unloaded idling refers to idling under no loads, i.e., idling where the gear lever is in neutral while all of the electric systems such as the air conditioner, audios, and lights are turned off after warm-up.

Meanwhile, it is necessary for the process at step 51 to determine such a value that no engine stall occurs during when the vehicle runs or stops. Therefore, while the target engine output is higher than the unloaded idling equivalent output during usual running or at stops, a target engine output lower than the unloaded idling equivalent output may be calculated depending on the state of driving determined by the driver, for example, when decelerating in an expressway or running a downhill.

When it is determined at step 52 that the target engine output is lower than the unloaded idling equivalent output, a control signal is sent to the accessory driving control section 16 so as to request the accessory driving control section 16 to increase the load (output) of the accessories including the generator 12 (step 53).

In the case where the target engine output is lower than the unloaded idling equivalent output, the engine will fail to revolve stably if the engine output is to be lowered by controls such as cutting the fuel, stopping the cylinder, and retarding the ignition, for example. In other words, it is difficult for the engine 1 by itself to stably attain an engine output lower than the unloaded idling equivalent output. On the other hand, increasing the load of an accessory such as the generator 12 reduces the engine axis output accordingly. Therefore, when the target engine output is lower than the unloaded idling equivalent output, the accessory load is actively increased in order to obtain an engine axis output lower than the unloaded idling equivalent output stably instead of a desirable output of the accessory. The amount of increase in the accessory load at this time is represented by the following expression:

$$\text{Accessory load increase amount} = \text{unloaded idling equivalent output} - \text{target engine output.}$$

Data of the accessory load increase amount obtained by the above expression is sent as a part of control signals to the accessory driving control section 16. Then, the accessory driving control section 16 controls the load of the generator 12 or the like according to the accessory load increase amount. Here, the load of the generator 12 or the like is increased by an amount corresponding to the difference between the unloaded idling equivalent output and the target engine output, so that the excess part of engine output with respect to the target engine output can be canceled out by the accessory load. As a technique for controlling the load, the load of the generator 12 may be increased alone or loads of a plurality of accessories in use may be increased in a favorable balance.

After carrying out the process at step 53, the idle-up amount (amount of increase in the number of revolutions or the like) in the engine 1 is set to zero (step 54). That is, no idle-up control is performed when the target engine output is lower than the target engine output.

Figure 3:
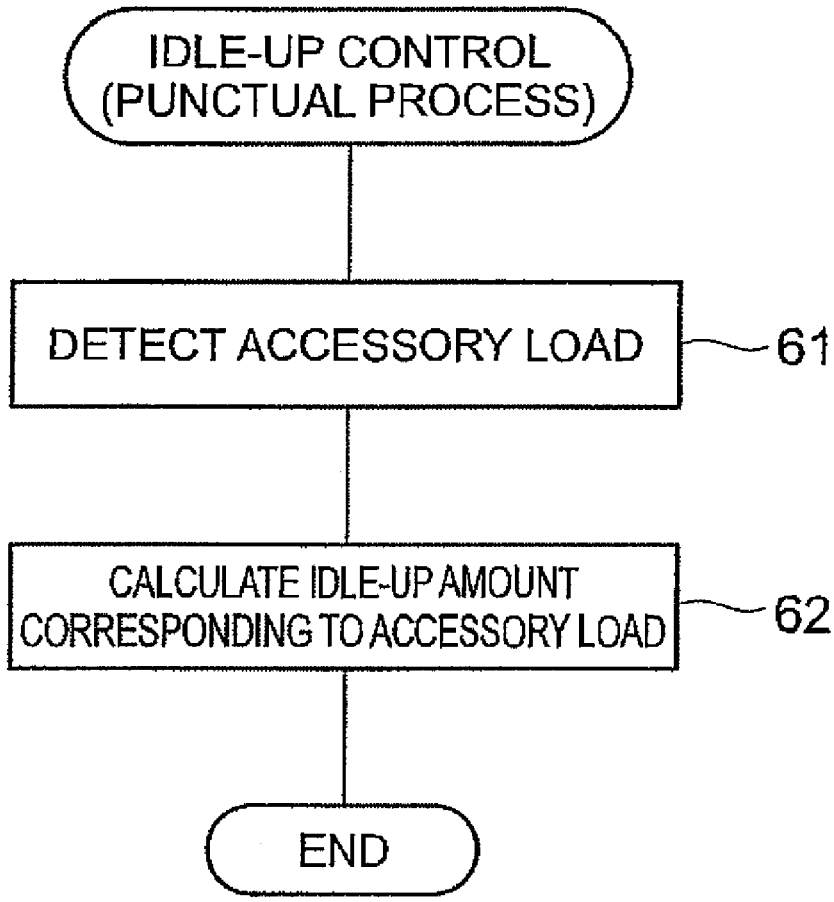
FIG. 3 is a flowchart illustrating details of a procedure of an idle-up amount verification process represented in FIG. 2.

When it is determined at step 52 that the target engine output is in a usual state not lower than the unloaded idling equivalent output, on the other hand, the idle-up amount at that time is verified (step 55). FIG. 3 illustrates details of the processing procedure of this step 55. The process illustrated in FIG. 3 is executed as a punctual process (e.g., at intervals of 4 ms) different from the engine output control process.

First, in this chart, the load of an accessory such as the generator 12 is detected (step 61). Here, a generated current is detected as a load in the generator 12.

Figure 4:
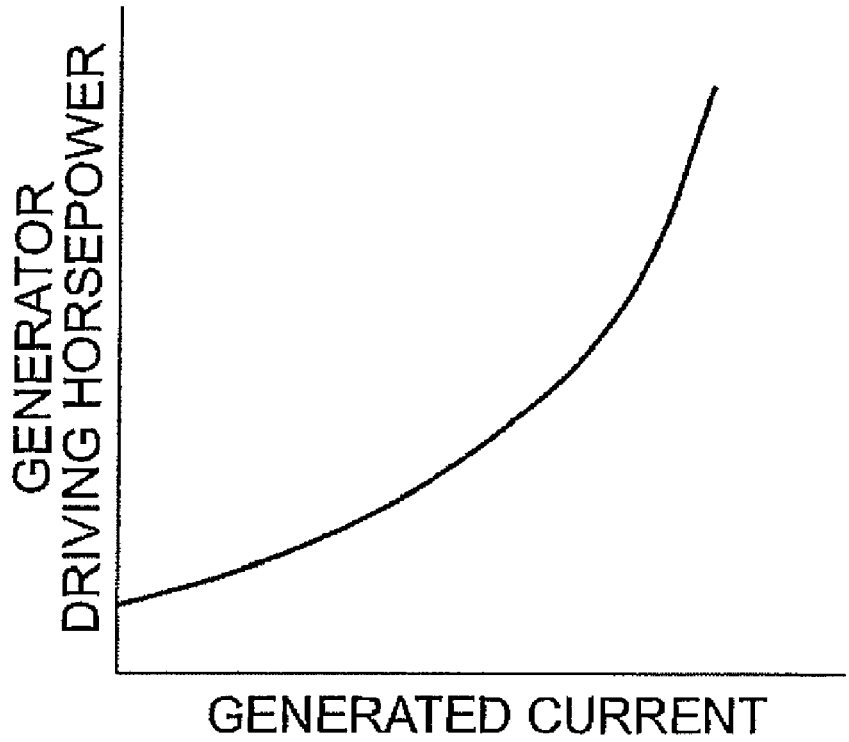
FIG. 4 is a graph illustrating an example of generator load characteristics.

Subsequently, an idle-up amount corresponding to the accessory load is determined (step 62). Specifically, load characteristic data indicating the relationship between generated current (generated electric power amount) and driving horsepower has been stored beforehand in a memory of the ECU 15 as illustrated in FIG. 4. A driving horsepower corresponding to the generated current is determined by using such generator load characteristic data, and a required idle-up amount is calculated from the driving horsepower. This yields an idle-up amount corresponding to the load of the generator 12.

Load characteristic data have also been prepared beforehand for the other accessories such as an air conditioner. When a plurality of accessories are used simultaneously, the total of loads of the accessories is calculated, and an idle-up amount corresponding to the total load value is determined.

Next, returning to FIG. 2, the idle-up amount of engine output obtained by steps 54, 55 is added to the target engine output determined by step 51, and the result is defined as a corrected target engine output (step 56).

The corrected target engine output is not a target value of an axial output or axial torque such as the target engine output determined at step 51, but a target value of combustion energy (indicated output or indicated torque) generated by the combustion within the cylinder of the engine 1. Here, the indicated output (indicated torque) is the sum of the axial output (axial torque) and the output (torque) consumed by frictions and the like within the engine and loads of the accessories.

Subsequently, control amounts for the throttle opening degree, fuel injection amount, ignition timing, and the like for realizing the corrected target engine output determined at step 56 are computed, and engine devices such as the throttle valve 5, injector 8, and ignition plug (not depicted) are controlled according to these control amounts (step 57).

In the foregoing, step 51 of the ECU 15 constitutes output target setting means for setting an output target value of the internal combustion engine. Steps 52, 53 of the ECU 15 and the accessory driving control section 16 constitute accessory control means for controlling a load of the accessory. Steps 52, 54, 55 of the ECU 15 constitute idle-up adjusting means for setting an idle-up amount in the internal combustion engine. Step 56 of the ECU 15 constitutes correction means for correcting the output target value by adding an output corresponding to the idle-up amount to the output target value set by the output target setting means. Step 57 of the ECU 15 constitutes output control means for controlling an output of the internal combustion engine by using the output target value set by the output target setting means.

In this embodiment constructed as above, the target engine output becomes higher than the unloaded idling equivalent output during usual running or at stops, so that an idle-up amount corresponding to the load of an accessory is determined, whereby the throttle valve 5, injector 8, and the like are controlled according to the corrected target engine output obtained by using this idle-up amount. Hence, the idle-up control of the engine 1 is carried out. This prevents engine stalls and vibrations from occurring even when the load of the accessory changes, whereby a stable idling state can be secured.

When the target engine output becomes lower than the unloaded idling equivalent output because of a driving operation by the driver during decelerating in an expressway or running a downhill, for example, on the other hand, the accessory is controlled so as to increase its load, whereby the engine output (axial output or axial torque) decreases as the load of the accessory increases. Therefore, even when the combustion energy is generated to a certain extent within the engine 1 by somewhat depressing the accelerator pedal 17 at the time of deceleration, for example, adjusting the amount of increase in load of the accessory can yield an engine output lower than the unloaded idling equivalent output as a result.

Thus actively utilizing the load control of the accessory as means for reducing the engine output makes it unnecessary to use the throttle control together with controls such as cutting the fuel, stopping the cylinder, and retarding the ignition, whereby the engine output can be controlled continuously (in an analog manner) so as to become the unloaded idling equivalent power or less. Consequently, even when an engine output lower than the unloaded idling equivalent output is demanded, the actual output of the engine 1 can be controlled finely so as to become the target engine output. As a result, the stability of running/driving and mileage can be made better.

When the target engine output is lower than the unloaded idling equivalent output, the idle-up control is not carried out, so that the idle-up amount of combustion energy is kept from being generated. This also improves the mileage.

The present invention is not limited to the above-mentioned embodiment. For example, though the above-mentioned embodiment sets the idle-up amount to zero when the target engine output is lower than the unloaded idling equivalent output, this is not restrictive in particular; it will be sufficient if the idle-up amount is set smaller than usual (when the target engine output is not lower than the unloaded idling equivalent output).

Though the above-mentioned embodiment sets the idle-up amount corresponding to the load of the accessory in the ECU 15, such an idle-up amount setting process may be carried out in the accessory driving control section 16, and the idle-up amount obtained there may be sent to the ECU 15.

The internal combustion engine control apparatus of the present invention is applicable to any of gasoline and diesel engines as a matter of course.

INDUSTRIAL APPLICABILITY

The present invention can control the internal combustion engine output with a high accuracy even when an internal engine output lower than the unloaded idling equivalent output is demanded. This can improve the stability of running/driving and mileage.

The invention claimed is:

1. An internal combustion engine control apparatus for controlling an internal combustion engine mounted to a vehicle, the apparatus comprising:

an accessory driven through an output axis of the internal combustion engine;

accessory control device to control a load of the accessory;

output target setting device to set an output target value of the internal combustion engine; and output control device to control an output of the internal combustion engine by using the output target value set by the output target setting device;

wherein the accessory control device controls the load of the accessory such that, when the output target value is lower than an output during unloaded idling, the load increases so as to make the output of the internal combustion engine lower than that during unloaded idling due to the load of the accessory in order to attain the output target value.

2. An internal combustion engine control apparatus according to claim 1, wherein the accessory control device controls the load of the accessory such that the load increases by a difference between the output target value and the output during unloaded idling when the output target value is lower than the output during unloaded idling.

3. An internal combustion engine control apparatus according to claim 1, further comprising:

idle-up adjusting device to set an idle-up amount in the internal combustion engine; and correction device to correct the output target value by adding an output corresponding to the idle-up amount to the output target value set by the output target setting device;

wherein the output control device controls the output of the internal combustion engine according to the output target value corrected by the correction device; and wherein the idle-up adjusting device usually determines the idle-up amount corresponding to the load of the accessory and sets the idle-up amount smaller than usual when the output target value set by the output target setting device is lower than the output during unloaded idling.

4. An internal combustion engine control apparatus according to claim 1, wherein the accessory control device refrains from controlling the load of the accessory such that the load increases when the output target value is greater than the output during unloaded idling.

5. An internal combustion engine control apparatus according to claim 1, wherein the accessory control device controls the load of the accessory such that the load continuously increases when the output target value is lower than the output during unloaded idling.

* * * * *